United States Patent [19]

Müller

[11] 4,275,845

[45] Jun. 30, 1981

[54] FUEL INJECTOR FOR INTERNAL COMBUSTION ENGINES

[75] Inventor: Eckart Müller, Schwabach, Fed. Rep. of Germany

[73] Assignee: Maschinenfabrik Augsburg-Nurnberg Aktiengesellschaft, Nurenberg, Fed. Rep. of Germany

[21] Appl. No.: 29,080

[22] Filed: Apr. 11, 1979

[30] Foreign Application Priority Data

Apr. 7, 1978 [DE] Fed. Rep. of Germany ..... 2814999

[51] Int. Cl.[3] ..... B05B 1/30

[52] U.S. Cl. ..... 239/533.12

[58] Field of Search ..... 239/533.3–533.12, 239/453

[56] References Cited

U.S. PATENT DOCUMENTS

| | | | |
|---|---|---|---|
| 2,951,647 | 9/1960 | Dreisin | 239/453 |
| 3,035,780 | 5/1962 | Peras | 239/533.4 X |
| 3,642,212 | 2/1972 | Voit | 239/533.4 |

FOREIGN PATENT DOCUMENTS

| | | | |
|---|---|---|---|
| 662061 | 7/1935 | Fed. Rep. of Germany | 239/533.12 |
| 2047391 | 10/1971 | Fed. Rep. of Germany | 239/533.3 |
| 2709892 | 9/1978 | Fed. Rep. of Germany | 239/533.3 |
| 2743339 | 5/1979 | Fed. Rep. of Germany | 239/533.4 |

*Primary Examiner*—Robert B. Reeves
*Assistant Examiner*—Gene A. Church
*Attorney, Agent, or Firm*—Becker & Becker, Inc.

[57] ABSTRACT

A fuel injector, for internal combustion engines, having a nozzle needle supported in a nozzle body so as to be axially displaceable therein. The nozzle needle, which can be lifted off its valve seat by the pressure of fuel, has a throttling pin which, at least during part of its lift, projects below the valve seat into a bore centrally arranged in the nozzle body. The throttling pin has at least one control edge or flat portion which is shaped and oriented in such a way that the fuel spray direction and/or the fuel spray characteristic or pattern vary with the nozzle needle lift.

7 Claims, 5 Drawing Figures

FUEL INJECTOR FOR INTERNAL COMBUSTION ENGINES

The present invention relates to a fuel injector for internal combustion engines having a nozzle needle which is axially displaceably supported in a nozzle body and can be lifted off its valve seat by the pressure of the fuel. The nozzle needle has a throttling pin which, as least during part of its lift, projects below its valve seat into a centrally arranged bore.

Such an injector, designed, however, purely as a pin nozzle, is known. With this known injector, the pin, which has a slightly reduced diameter at its free end, clears the injection hole to a greater or lesser extent depending on the existing fuel injection pressure. The intention was to provide controlled pre-injection of the fuel, with the nozzle needle being held on its valve seat by two springs having different characteristics and/or becoming operative at different times. In either case, the fuel spray direction, at all positions of the nozzle needle, always remains in the direction of the longitudinal axis of the injector. Only the character or pattern of the spray changes as the cross section of the opening increases.

It is a well-known fact that the quality of the mixture formation in the combustion chamber of an internal combustion engine essentially depends on the respective fuel spray position and/or direction as well as on the spray characteristic or pattern. In this respect, it has been considered advantageous for a long time for various mixture formation methods to impart to the fuel spray, during starting as well as in the lower load and/or speed range of the engine, a direction by means of which a greater proportion of direct fuel/air mixing is obtained, while in the upper load and/or speed ranges, it is desirable to orient the spray more in a direction towards the combustion chamber wall in order to eliminate the well known detrimental peak pressures resulting from combustion proceeding at too fast a rate. This applies in particular to internal combustion engines employing the method of wall deposition of the fuel, because in this case a large proportion of the fuel is intended to be deposited in the form of a film onto the combustion chamber wall when the combustion chamber wall is adequately warmed up.

In order to also be able to vary the fuel spray orientation as a function of the lift of the nozzle needle, an injector, again of the purely pin type, has been proposed. According to this known injector, the spray hole is provided at one point or over part of its circumference with an eccentrically arranged gap which extends either over the full length of the spray hole or only over part of it.

Although it is possible by a suitable design of this gap to adapt the spray direction and the spray characteristic to a large extent to the respectively desired operating conditions, there are limits to doing so because the spray hole is invariably required to extend in the direction of the longitudinal axis of the nozzle. Furthermore, the production of such a gap is relatively complex and, consequently, expensive.

It is therefore an object of the present invention to improve a fuel injector of the type described above in such a way that the fuel spray direction can be varied within wide limits and/or its installation is suitable for nearly all conditions, and that it can be made in a simpler manner and at lower costs.

This object, and other objects and advantages of the present invention, will appear more clearly from the following specification in connection with the accompanying drawing, in which.

Figure 1:
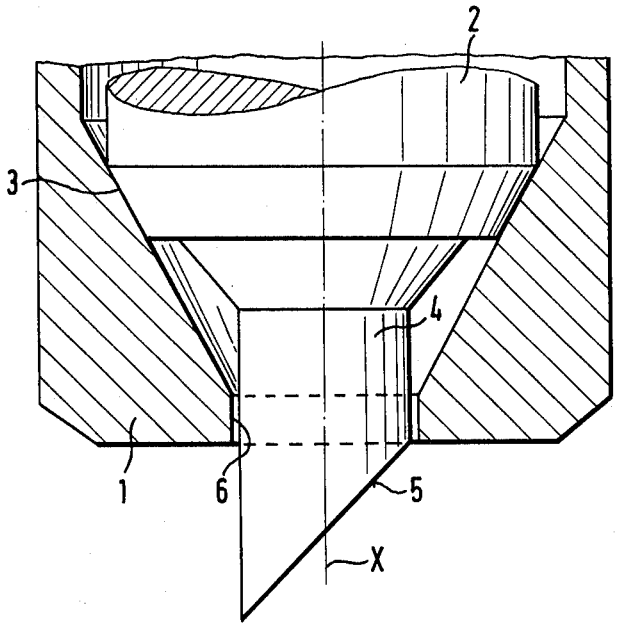
FIG. 1 is a longitudinal section through the lower part of one embodiment of an injector according to the present invention, with the nozzle needle seated on the valve seat.

The fuel injector of the present invention is characterized primarily in that the throttling pin has at least one control edge or flat portion which is shaped in such a way that the fuel spray direction and/or the fuel spray characteristic vary with the nozzle needle lift.

As the nozzle needle is lifted off its valve seat, only a small cross-sectional area of the spray hole is initially freed; this area progressively increases. In other words, the throttling pin, which is provided on the nozzle needle and is definitely easier to form with an accurate shape, is used as the control means for the spray direction. This applies not only to pin nozzles, where the throttling pin has a control edge, but also to hole-type nozzles, where a flat portion is provided on the throttling pin. Since in the latter case the spray hole can be given practically any desired direction, the range of application is naturally considerably increased. In this connection, it is proposed according to the invention to form the centrally arranged bore as a blind hole, with the spray hole communicating with the blind hole. The flat portion is expediently formed by a cylindrical section on the throttling pin, i.e. the pin is simply somewhat ground down on one side. Obviously, the flat portion can also be formed as a segmental cutout, a semicircular cutout, or a similar configuration on the throttling pin, but such variants would already be more expensive.

If the spray hole can extend centrally in the direction of the nozzle longitudinal axis, it simultaneously forms the central bore, which can then be omitted. In such a case, it is easy to make the control edge by merely grinding the end face of the throttling pin at an angle to the longitudinal axis of the nozzle. It should also be mentioned that the nozzle needle has in all cases to be prevented from turning, because otherwise the spray direction would then also vary during operation without any change of the needle lift.

It is obvious that other control edges or flat portions would also be within the scope of the present invention, the important criteria being only that they be provided on the throttling pin and that they fulfill the desired purpose.

Referring now to the drawings in detail, a nozzle needle 2 is displaceably supported in the direction of the nozzle longitudinal axis x in the lower part of a nozzle body 1. The nozzle needle 2 has a conical valve seat 3 and, at its bottom end, a throttling pin 4.

Figure 2:
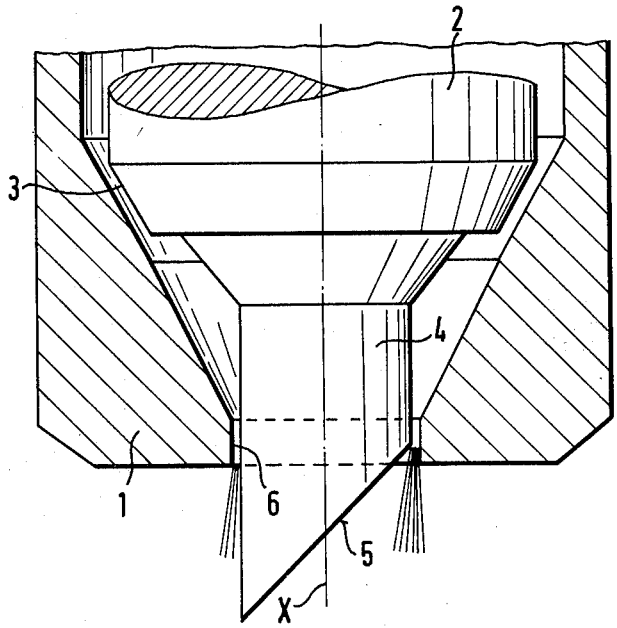
FIG. 2 shows the injector of FIG. 1 with the nozzle needle slightly open.
Figure 3:
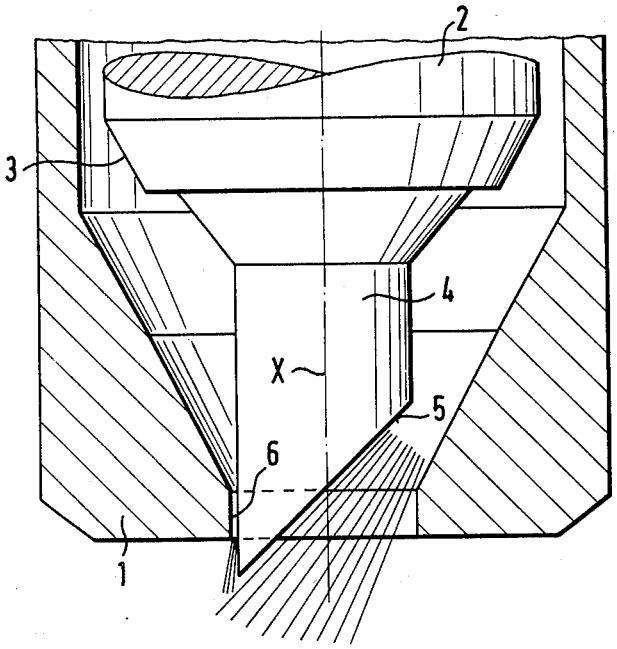
FIG. 3 shows the injector of FIG. 1 with the nozzle needle nearly entirely open.

In FIGS. 1–3, the throttling pin 4 has a slanted control edge 5 and projects into a bore 6 arranged centrally in the nozzle body 1; the bore 6 simultaneously forms the spray hole. With the nozzle needle 2 closed, the spray hole 6 is closed by the cylindrical throttling pin 4 except for an annular gap (FIG. 1). If the nozzle needle 2 is lifted only slightly off its valve seat 3, as shown in FIG. 2, the fuel will flow through the narrow annular gap essentially in a direction along the longitudinal axis x of the nozzle. As the nozzle needle 2 is further opened, the fuel spray is deflected progressively further by the control edge 5, which becomes more and more important or effective, resulting in a spray which is at an angle relative to the longitudinal axis x of the nozzle, as indicated schematically in FIG. 3.

Figure 4:
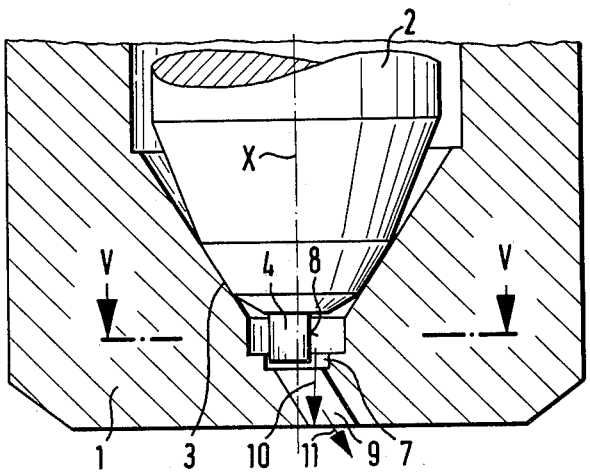
FIG. 4 is a longitudinal section through the lower part of another embodiment of the injector according to the present invention.
Figure 5:
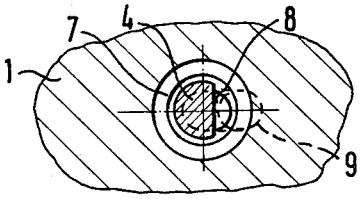
FIG. 5 is a partial section taken along the line V—V of FIG. 4.

In FIG. 4, the throttling pin 4 projects into a blind hole 7, from which a spray hole 9 extends outwardly at an angle to the longitudinal axis x of the nozzle. It can be clearly seen from FIG. 5 that the throttling pin 4 has a flat portion 8.

If the nozzle needle 2 is lifted slightly off its valve seat 3, the flat portion 8 of the pin 4 results in a free discharge cross-sectional area in the shape of a segment of a circle, and the fuel is discharged essentially parallel to the longitudinal axis x of the nozzle in the direction of the arrow 10. With the nozzle needle 2 fully open, the full cross-sectional area of the spray hole 9 is free, so that the fuel is injected at an angle in the direction of the arrow 11.

It is, of course, to be understood that the present invention is in no way limited to the specific disclosure of the specification and drawings, but also encompasses any modifications within the scope of the appended claims.

What I claim is:

1. A fuel injector for internal combustion engines, comprising in combination:

a nozzle body having a bore centrally arranged therein and operatively communicating with said internal combustion engine; and a nozzle needle having a valve seat for providing supporting contact with a correspondingly shaped portion of said nozzle body, said nozzle needle being axially displaceable in said body in the longitudinal direction thereof for movement between a closed state of said injector, wherein said valve seat is in contact with said nozzle body, and varying degrees of an opened state of said injector, wherein said valve seat is lifted off said nozzle body by fuel pressure to allow fuel to pass to said centrally arranged bore, said nozzle needle including a throttling pin determinative for fuel stream directions as well as fuel stream characteristic or pattern and having an end face which, at least during a portion of said open states of said injector, projects into said centrally arranged bore, said throttling pin being provided with at least one smooth flat surface which is arranged to receive fuel thereagainst and which is arranged in such a way as to vary at least one of the fuel stream directions and the fuel stream characteristic or pattern during movement of said nozzle needle between said closed and open states of said injector, said at least one flat surface being a flat portion having a plane extending substantially parallel to the longitudinal axis of said nozzle body and being a control edge on said end face of said throttling pin, at least a portion of said end face of said throttling pin always projecting into said bore.

2. A fuel injector in combination according to claim 1, in which said flat portion is formed by a cylindrical section on said throttling pin.

3. A fuel injector in combination according to claim 1, in which said flat portion is formed by a segmental cutout on said throttling pin.

4. A fuel injector in combination according to claim 1, in which said centrally arranged bore is formed as a blind hole, said end face of said throttling pin extending substantially perpendicular to the longitudinal axis of said nozzle body, and said nozzle body includes a spray hole for communicating said blind hole with said internal combustion engine.

5. A fuel injector in combination according to claim 4, in which said spray hole extends at an angle to the longitudinal axis of said nozzle body, and in which said flat portion of said throttling pin is arranged at the side of said spray hole in corresponding direction.

6. A fuel injector for internal combustion engines, comprising in combination:

a nozzle body having a bore centrally arranged therein and operatively communicating with said internal combustion engine; and a nozzle needle having a valve seat for providing supporting contact with a correspondingly shaped portion of said nozzle body, said nozzle needle being axially displaceable in said nozzle body in the longitudinal direction thereof for movement between a closed state of said injector, wherein said valve seat is in contact with said nozzle body, and varying degrees of an opened state of said injector, wherein said valve seat is lifted off said nozzle body by fuel pressure to allow fuel to pass to said centrally arranged bore, said nozzle needle including a throttling pin determinative for fuel stream directions as well as fuel stream characteristic or pattern and having an end face which, at least during a portion of said open states of said injector, projects into said centrally arranged bore, said throttling pin being provided with at least one smooth flat surface which is arranged to receive fuel thereagainst and which is arranged in such a way as to vary at least one of the fuel stream directions and the fuel stream characteristic or pattern during movement of said nozzle needle between said closed and open states of said injector, said at least one flat surface being a control edge on said end face of said throttling pin, said end face extending at an inclined angle to the longitudinal axis of said nozzle body.

7. A fuel injector in combination according to claim 6, in which said centrally arranged bore simultaneously forms a spray hole, and in which at least a portion of said end face of said throttling pin always projects into said spray hole.

* * * * *